US008968055B2

(12) United States Patent
Chen et al.

(10) Patent No.: US 8,968,055 B2
(45) Date of Patent: Mar. 3, 2015

(54) METHODS AND APPARATUS FOR PRE-CHEMICAL MECHANICAL PLANARIZATION BUFFING MODULE

(75) Inventors: Hui Chen, Burlingame, CA (US); Allen L. D'Ambra, Burlingame, CA (US); Jim Atkinson, Los Gatos, CA (US); Hung Chen, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 290 days.

(21) Appl. No.: 13/459,177

(22) Filed: Apr. 28, 2012

(65) Prior Publication Data

US 2013/0288578 A1 Oct. 31, 2013

(51) Int. Cl.
*B24B 1/00* (2006.01)

(52) U.S. Cl.
USPC ..... 451/59; 451/286; 451/288

(58) Field of Classification Search
USPC ..... 451/59, 286, 288
See application file for complete search history.

(56) References Cited

U.S. PATENT DOCUMENTS

| | | | | |
|---|---|---|---|---|
| 5,738,574 | A * | 4/1998 | Tolles et al. | 451/288 |
| 5,762,544 | A | 6/1998 | Ziniga et al. | |
| 5,804,507 | A | 9/1998 | Perlov et al. | |
| 6,416,616 | B1 | 7/2002 | Walker | |
| 6,435,941 | B1 | 8/2002 | White | |
| 6,585,572 | B1 | 7/2003 | Saldana et al. | |
| 6,857,950 | B2 * | 2/2005 | Hayashi et al. | 451/397 |
| 8,524,035 | B2 * | 9/2013 | Eisenstock et al. | 156/345.12 |
| 2002/0019204 | A1 * | 2/2002 | Takahashi et al. | 451/286 |

FOREIGN PATENT DOCUMENTS

| | | |
|---|---|---|
| JP | 2001-044157 | 2/2001 |
| KR | 10-2006-0002191 | 1/2006 |

OTHER PUBLICATIONS

International Search Report and Written Opinion of International Application No. PCT/US2013/036764 mailed Jul. 1, 2013.
International Preliminary Report on Patentability and Written Opinion of International Application No. PCT/US2013/036764 mailed Nov. 6, 2014.

* cited by examiner

*Primary Examiner* — Joseph J Hail
*Assistant Examiner* — Shantese McDonald
(74) *Attorney, Agent, or Firm* — Dugan & Dugan, PC

(57) ABSTRACT

The present invention provides methods and apparatus for a pre-CMP semiconductor substrate buffing module. The invention includes a polishing pad assembly adapted to be rotated against a major surface of a substrate; a chuck adapted to hold the substrate and to rotate the substrate against the polishing pad assembly as the polishing pad assembly is rotated; and a lateral motion motor adapted to oscillate the polishing pad assembly laterally across the major surface of the substrate while the polishing pad assembly is rotated against the rotating substrate. Numerous additional features are disclosed.

16 Claims, 2 Drawing Sheets

METHODS AND APPARATUS FOR PRE-CHEMICAL MECHANICAL PLANARIZATION BUFFING MODULE

FIELD OF THE INVENTION

The present invention generally relates to chemical mechanical planarization (CMP) systems, and more particularly is directed to methods and apparatus for buffing a substrate before performing a CMP process.

BACKGROUND OF THE INVENTION

Existing chemical mechanical planarization (CMP) systems may sometimes receive substrates for processing that have relatively large debris particles stuck to the surface of the substrates. Frequently pre-CMP rinse systems are unable to effectively remove these larger particles and when the substrate is polished using a conventional CMP system, the particles can cause deep scratches in the surface of the substrates. To address this problem using a conventional CMP system, substrates are sometimes polished twice using different membrane pressures. This solution however, has the drawback of slowing down throughput. Thus, what is needed are methods and apparatus that enable removal of the large debris particles without slowing down CMP processing throughput.

SUMMARY OF THE INVENTION

Inventive methods and apparatus are provided for a pre-CMP buffing module for a CMP system. In some embodiments, the buffing module includes a polishing pad assembly adapted to be rotated against a major surface of a substrate; a chuck adapted to hold the substrate and to rotate the substrate against the polishing pad assembly as the polishing pad assembly is rotated; and a lateral motion motor adapted to oscillate the polishing pad assembly laterally across the major surface of the substrate while the polishing pad assembly is rotated against the rotating substrate.

In some embodiments, the invention provides a method of substrate buffing. The method includes rotating a polishing pad assembly against a major surface of a substrate; rotating a chuck holding the substrate to rotate the substrate against the polishing pad assembly as the polishing pad assembly is rotated; and oscillating the polishing pad assembly laterally across the major surface of the substrate while the polishing pad assembly is rotated against the rotating substrate.

In yet other embodiments, the invention provides a method of using a buffing module. The method includes providing a buffing module; loading a substrate into the buffing module; applying a down force on the substrate with a polishing pad assembly of the buffing module; and buffing the substrate by concurrently rotating the polishing pad assembly, rotating the substrate, and oscillating the polishing pad assembly laterally.

Numerous other aspects are provided. Other features and aspects of the present invention will become more fully apparent from the following detailed description, the appended claims and the accompanying drawings.

DETAILED DESCRIPTION

The present invention provides improved methods and apparatus for pre-treating semiconductor substrates to remove large debris particles from the surface of the substrate before CMP processing. The invention includes a pre-CMP semiconductor substrate buffing module which includes a rotating polishing pad assembly suspended from a motorized gantry that allows the polishing pad assembly to be moved laterally across the surface of a substrate while the substrate is buffed by the rotating polishing pad assembly. The substrate is supported on a rotating substrate chuck which securely holds and rotates the substrate during buffing. The module is contained in a tank and a cleaning/polishing slurry may be applied to the surface of the substrate through the polishing pad assembly. Both the motor for rotating the polishing pad assembly and the motor for rotating the substrate chuck may be hollow shaft motors. The slurry may be applied to the back of the polishing pad assembly via the hollow shaft of the motor for rotating the polishing pad assembly. The used slurry may be drained from the tank via the hollow shaft of the motor for rotating the substrate chuck.

In some embodiments, the pre-CMP buffing module may be part of a CMP system wherein substrates to be CMP processed are first buffed in the pre-CMP buffing module. The buffing module may include a substrate holder adapted to lift the substrate off the substrate chuck to facilitate loading and unloading of the module using an end effector. In addition, the buffing module may include a polishing pad lifting actuator to raise the gantry to better enable (e.g., provide more clearance for a robot) loading and unloading of the substrate.

Figure 1:
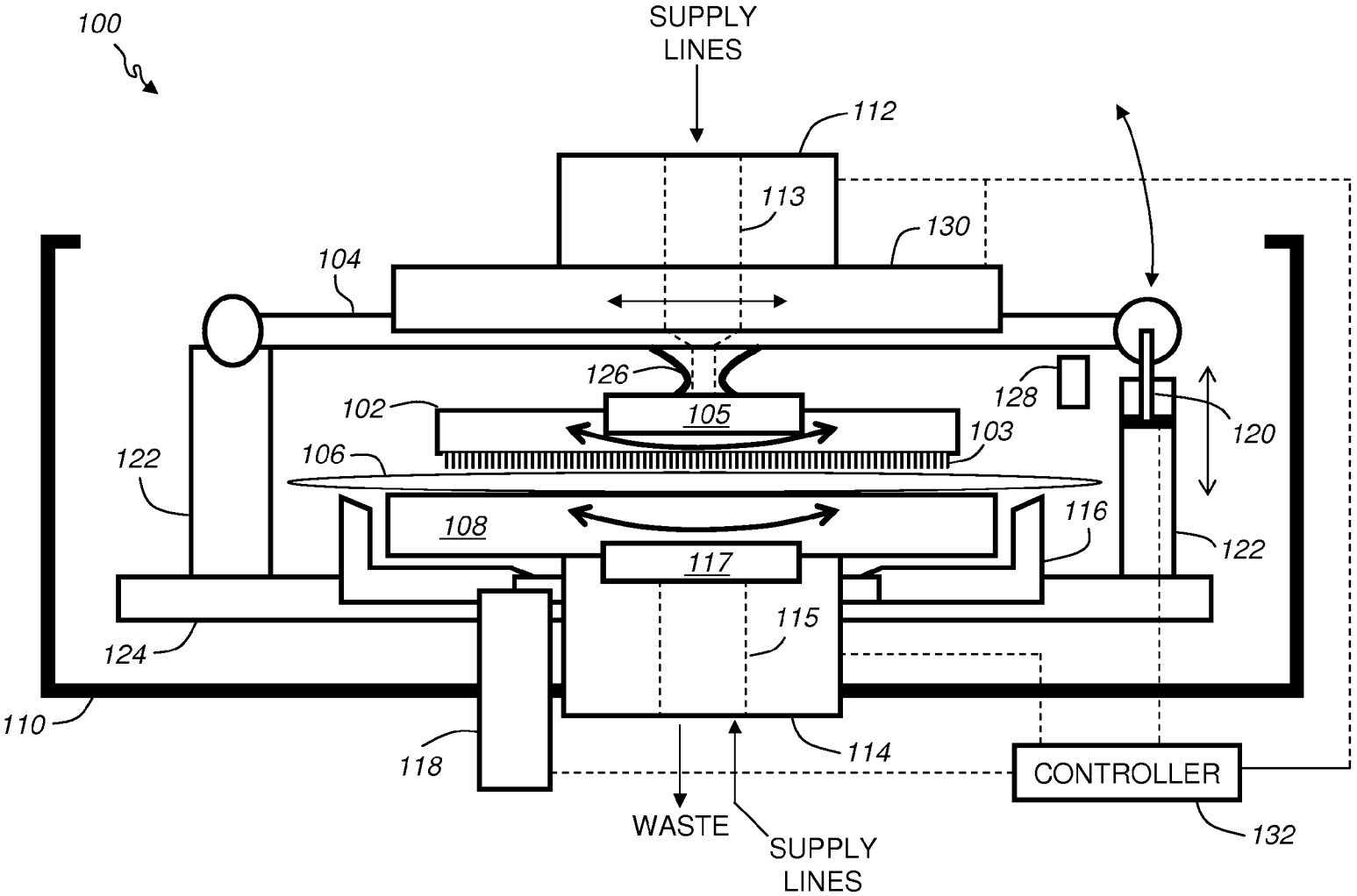
FIG. 1 is a schematic block diagram depicting an example pre-CMP buffing module for a CMP system according to some embodiments of the present invention.

Turning to FIG. 1, an example embodiment of a pre-CMP buffing module 100 is illustrated. A rotating polishing pad assembly 102 is suspended from a motorized gantry 104. The polishing pad assembly 102 may include a polishing pad 103, a fluid distribution manifold 105, and a carriage adapted to securely, but releasably, hold the polishing pad 103. In some embodiments, an air pressure controlled pneumatic clamping mechanism in the carriage may be used to releasably hold the polishing pad 103. The motorized gantry 104 allows the polishing pad assembly 102 to be moved laterally across the surface of a substrate 106. This lateral oscillating motion of the rotating polishing pad assembly 102 while the substrate 106 is buffed by the assembly 102 enhances the consistency of the buffing of the substrate 106 and ensures that the entire surface of the substrate 106 is buffed. In some embodiments, the polishing pad assembly 102 has a pad diameter smaller than the diameter of the substrate 106. The substrate 106 is supported on a rotating substrate chuck 108. The rotating substrate chuck 108 securely, but releasably, holds and rotates the substrate 106 during buffing.

In some embodiments, the module 100 may be contained in a tank 110 and slurry, deionized (DI) water, pressurized nitrogen gas ($N_2$), pressurized clean dry air (CDA), other cleaning fluids, other chemicals, etc. from a supply may be applied to the surface of the substrate 106 during buffing. The slurry and other fluids may be distributed over the polishing pad 103 via the manifold 105 and dispensed onto the substrate 106 through the polishing pad assembly 102. In some embodiments, the motor 112 for rotating the polishing pad assembly 102 may be a hollow shaft motor adapted to allow various channels carrying slurry and other fluids to be piped through the hollow shaft 113 to the manifold 105. Thus, in some embodiments, slurry and/or other fluids may be applied through the back (top) of the polishing pad assembly 102 via the hollow shaft 113 of the motor 112 for rotating the polishing pad assembly. Note that a rotary union may be coupled to the motor shaft 113 to facilitate coupling various supply lines to the moving parts of the buffing module 100. In some embodiments, the pressurized CDA channeled to the manifold 105 may be coupled to and used to operate the pneumatic clamping mechanism in the carriage used to releasably hold the polishing pad 103.

The motor 114 for rotating the substrate chuck 108 may also be a hollow shaft motor adapted to allow channels carrying used slurry and other fluids to be piped through the hollow shaft 115. Thus, the used fluids may be drained from the tank 110 via the hollow shaft 115 of the motor 114 for rotating the substrate chuck. Note that some of the channels in the hollow shaft 115 may allow fluids to be brought into the tank 110 to the substrate 106. For example, purging gas (e.g., $N_2$) may be channeled through the hollow shaft 115 to a distribution manifold 117 for purging and/or drying the substrate 106 before or during unloading of the substrate 106 after processing in the buffing module 100 is complete. In addition, vacuum pressure lines may be extended to the manifold 117 in the chuck 108 via the shaft 115 to provide vacuum pressure to operate the substrate holding function of the chuck 108. Again, a rotary union may be coupled to the motor 114 to allow supply and drainage lines to be coupled to moving parts of the buffing module 100.

The buffing module 100 may include a substrate holder 116 adapted to lift the substrate 106 off the substrate chuck 108 to facilitate loading and unloading of the module 100 using an end effector. A substrate holder lift actuator 118 may be provided to raise and lower the substrate holder 116. In addition, the buffing module 100 may include a polishing pad lifting actuator 120, for example, built into one of the gantry upright supports 122. The polishing pad lifting actuator 120 may be adapted to raise the gantry 104 to better enable loading and unloading of the substrate 106 from the module 100. The gantry upright supports 122, the motor 114 for rotating the substrate chuck, and the substrate holder lift actuator 118 may all be coupled to a base plate 124.

In operation, the pre-CMP buffing module 100 raises the gantry 104 and the substrate holder 116 using the polishing pad lifting actuator 120 and the substrate holder lift actuator 118, respectively. A substrate 106 is loaded onto the substrate chuck 108 (e.g., a vacuum chuck or any other practicable type of chuck). The gantry 104 and the substrate holder 116 are lowered by the polishing pad lifting actuator 120 and the substrate holder lift actuator 118, respectively.

A predetermined amount of downward pressure is applied to the substrate 106 by the polishing pad assembly 102. To insure the polishing pad assembly 102 remains parallel with the major surface of the substrate 106, a flexible linkage 126 (e.g., a gimbal, ball joint, etc.) may be used between the motor 112 and the polishing pad assembly 102. Thus, even if the gantry 104 is not level or parallel with the substrate 106, the polishing pad 103 remains substantially parallel with the substrate 106. In some embodiments, the shaft 113 through the motor 112 may extend down past the lateral motion motor 130 and through the flexible linkage 126 to allow fluid supply channels to reach the fluid distribution manifold 105. Thus, the flexible linkage 126 may include a hollow shaft. In some embodiments, a hard stop 128 may be provided to limit the downward pressure of the polishing pad assembly 102 on the substrate 106.

Slurry and/or other fluids are applied to the polishing pad assembly 102 via the hollow shaft 113 of the motor 112 for rotating the polishing pad assembly 102. The polishing pad assembly motor 112 rotates the polishing pad assembly 102 and the substrate chuck motor 114 rotates the substrate 106, concurrently. In addition, a lateral motion motor 130 mounted on the gantry 104 also moves the polishing pad assembly 102 laterally oscillating back and forth across the substrate 106. The buffing continues for a predefined period of time or until a desired endpoint is reached (e.g., torque measurement sensors may be coupled to the motors and an end point may be identified based upon a detected change in the applied torque). The used slurry flows out of the tank 110 via a channel though the hollow shaft 114 of the substrate chuck motor 114.

Upon buffing completion, the pre-CMP buffing module 100 stops the motors 112, 114, 130 and raises the gantry 104 and the substrate holder 116 using the polishing pad lifting actuator 120 and the substrate holder lift actuator 118, respectively. The substrate 106 is purged with $N_2$, removed from the chuck 108, and transferred to a CMP polisher for CMP processing. In some embodiments, a controller 132 (e.g., a computer) adapted to execute a program is electronically coupled to each of the motors 112, 114, 130, actuators 118, 120, valves in the manifolds 105, 117, and any other controllable components (e.g., fluid supply valves and pumps, vacuum pressure supplies, drainage valves and pumps, purge valves, etc.). In addition, the controller 132 may be connected to any number of meters and sensors (e.g., a current measurement meter on the motor 112 that drives the polishing pad assembly, a fluid supply valve status sensor on the slurry supply channel, etc.) used to monitor operation and status of the buffing module 100 and associated components. The control program is adapted to perform the methods and operate the pre-CMP buffing module 100 of the present invention by causing the controller 132 to send signals to, and receive signals from, the components.

Figure 2:
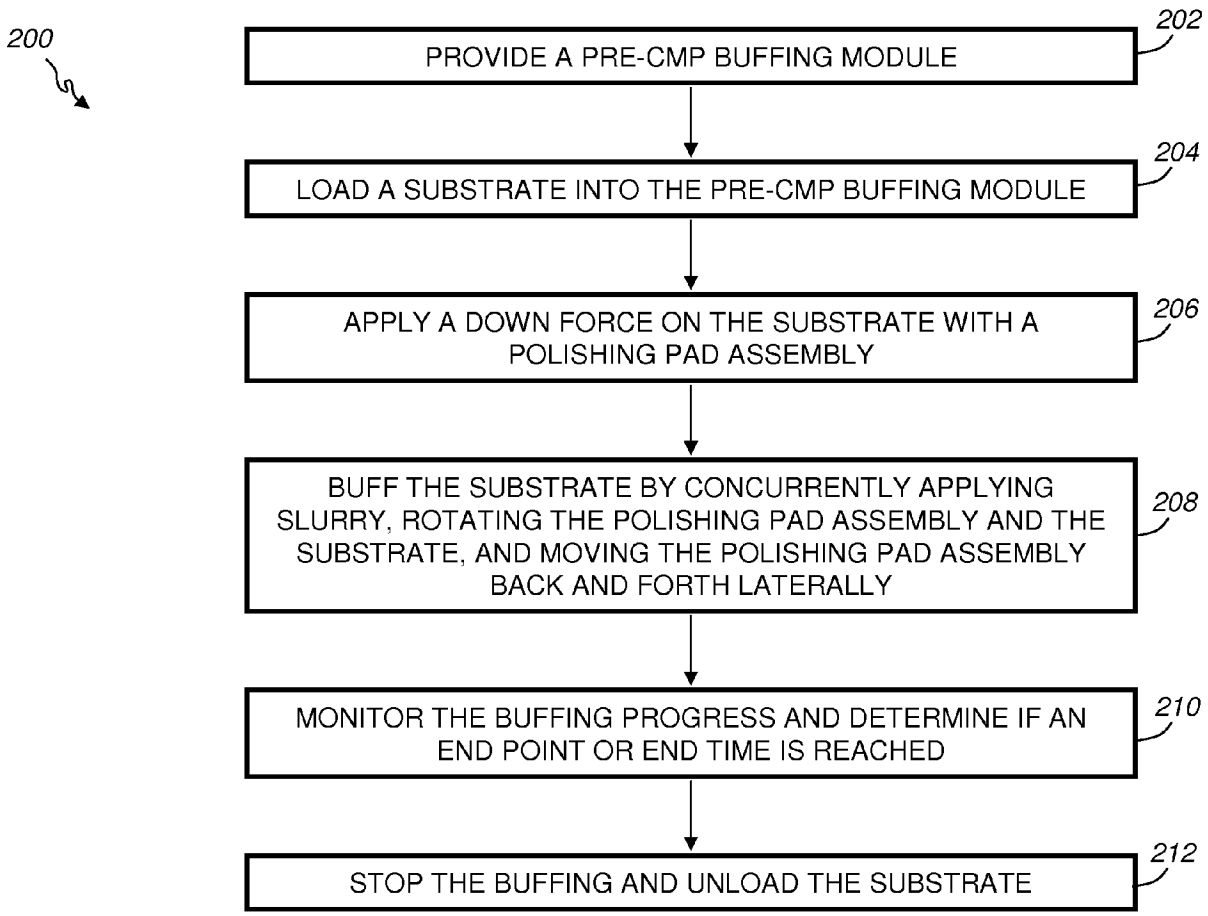
FIG. 2 is flowchart depicting an example method of buffing a substrate using a pre-CMP buffing module according to some embodiments of the present invention.

Turning now to FIG. 2, a flow chart depicting an example method 200 of pre-CMP buffing a substrate is provided. In Step 202, a pre-CMP buffing module 100 is provided. In Step 204, a substrate 106 is loaded into the pre-CMP buffing module 100. In Step 206, the polishing pad assembly 102 is lowered onto the substrate 106 to apply a down force on the substrate 106. In Step 208, the substrate 106 is buffed by applying slurry (and/or other fluids) via the polishing pad assembly 102, rotating the polishing pad assembly 102, rotating the substrate 106 (i.e., against the polishing pad assembly 102), and moving the polishing pad assembly 102 back and forth laterally. All of this is may be done concurrently. The rate and direction of the rotation of the polishing pad assembly 102 and the substrate 106 may be varied to optimize the buffing and to ensure debris particles are removed. The frequency with which the polishing pad assembly 102 is moved laterally to repeatedly sweep across the substrate 106 and the rate slurry or other fluids are flowed onto the substrate may also be optimized to enhance the buffing and to ensure debris particles are removed.

In Step 210, the controller 132 monitors the buffing progress and determines if an end point or end time is reached. In Step 212, the motors 112, 114, 130 are stopped, the tank is drained, and the substrate is purged, released from the chuck, lifted off the chuck, and unloaded.

Accordingly, while the present invention has been disclosed in connection with the preferred embodiments thereof, it should be understood that other embodiments may fall within the spirit and scope of the invention, as defined by the following claims.

The invention claimed is:

1. A substrate buffing module comprising:

a polishing pad assembly adapted to be rotated against a major surface of a substrate;

a chuck adapted to hold the substrate and to rotate the substrate against the polishing pad assembly as the polishing pad assembly is rotated;

a lateral motion motor adapted to oscillate the polishing pad assembly laterally across the major surface of the substrate while the polishing pad assembly is rotated against the rotating substrate;

a second motor adapted to rotate the polishing pad assembly and further adapted to include a hollow shaft; and a flexible linkage between the second motor and the polishing pad assembly, wherein the flexible linkage is adapted to allow the polishing pad assembly to remain substantially parallel with the major surface of the substrate while the polishing pad assembly is rotated and oscillated laterally.

2. The substrate buffing module of claim 1 further comprising a channel extending through the hollow shaft of the second motor and adapted to deliver slurry to the polishing pad assembly.

3. The substrate buffing module of claim 1 further comprising a gantry for supporting the lateral motion motor and the polishing pad assembly above the chuck.

4. The substrate buffing module of claim 3 further comprising an actuator adapted to raise and lower the gantry.

5. The substrate buffing module of claim 1 further comprising a third motor adapted to rotate the chuck and further adapted to include a hollow shaft, the hollow shaft of the third motor including a waste channel adapted to remove waste.

6. A method of substrate buffing comprising:

rotating a polishing pad assembly against a major surface of a substrate;

rotating a chuck holding the substrate to rotate the substrate against the polishing pad assembly as the polishing pad assembly is rotated; and oscillating the polishing pad assembly laterally across the major surface of the substrate while the polishing pad assembly is rotated against the rotating substrate, wherein rotating the polishing pad assembly includes rotating the polishing pad assembly using a second motor including a hollow shaft; and wherein rotating the polishing pad assembly includes coupling the second motor to the polishing pad assembly using a flexible linkage, wherein the flexible linkage is adapted to allow the polishing pad assembly to remain substantially parallel with the major surface of the substrate while the polishing pad assembly is rotated and oscillated laterally.

7. The method of claim 6 further comprising delivering slurry to the polishing pad assembly via a channel extending through the hollow shaft of the second motor.

8. The method of claim 6 further comprising supporting the lateral motion motor and the polishing pad assembly above the chuck using a gantry.

9. The method of claim 8 further comprising raising and lowering the gantry using an actuator.

10. The method of claim 6 wherein rotating the chuck includes rotating the chuck using a third motor including a hollow shaft, the hollow shaft of the third motor including a waste channel adapted to remove waste.

11. A method of buffing a substrate comprising:

providing a buffing module including a first motor having a hollow shaft and a slurry channel extending through the hollow shaft of the first motor, the slurry channel being adapted to deliver slurry, and a second motor having a hollow shaft and a waste channel extending through the hollow shaft of the second motor, the waste channel being adapted to remove waste;

loading a substrate into the buffing module;

applying a down force on the substrate with a polishing pad assembly of the buffing module, the polishing pad assembly being coupled to the first motor via a flexible linkage; and buffing the substrate by concurrently rotating the polishing pad assembly, rotating the substrate, and oscillating the polishing pad assembly laterally.

12. The method of claim 11 further comprising monitoring the buffing and determining whether an end point has been reached.

13. The method of claim 11 further comprising monitoring the buffing and determining whether an end time has been reached.

14. The method of claim 11 further comprising stopping the buffing and unloading the substrate.

15. The method of claim 11 wherein buffing the substrate further comprises applying slurry to the substrate concurrently with rotating the polishing pad assembly, rotating the substrate, and oscillating the polishing pad assembly laterally.

16. The method of claim 15 wherein applying slurry to the substrate includes applying slurry to the substrate through the polishing pad.

* * * * *